United States Patent [19]

Curry

[11] 4,274,764

[45] Jun. 23, 1981

[54] MINE ROOF SUPPORTING SYSTEM

[76] Inventor: Paul F. Curry, Box 775, Glade Spring, Va. 24340

[21] Appl. No.: 107,459

[22] Filed: Dec. 26, 1979

[51] Int. Cl.[3] ..... E21D 15/44

[52] U.S. Cl. ..... 405/291; 405/297

[58] Field of Search ..... 405/290, 291, 297, 299, 405/300; 299/33; 248/357; 91/170 MP

[56] References Cited

U.S. PATENT DOCUMENTS

| | | | |
|---|---|---|---|
| 1,781,063 | 11/1930 | Jessen | 405/290 |
| 2,795,935 | 6/1957 | Fitzgerald | 405/300 |
| 2,795,936 | 6/1957 | Blower et al. . | |
| 4,143,991 | 3/1979 | Stafford | 405/291 |
| 4,189,258 | 2/1980 | Maykemper et al. | 405/291 |

*Primary Examiner*—Stephen J. Novosad

*Attorney, Agent, or Firm*—Lane, Aitken, Ziems, Kice & Kananen

[57] ABSTRACT

A stabilizing arrangement for mine roof support systems of the type in which a series of support units, each including a transverse beam supported at opposite ends by extensible props, are interconnected by extensible struts in a manner to be self-advancing by alternate retraction of support units from a roof supporting condition and extension of the struts to advance such retracted units relative to others of such units which are in an extended roof engaging condition. The connection of each prop to the beam in a given unit is pivotal to allow deflection of the beam and props of a supporting unit from a normal perpendicular relationship under load. The stabilizing means restores the props and beam to a normal perpendicular relationship for advancing movement of each support unit. The supporting units are further stabilized relative to the struts by prop supporting brackets permitting canting movement of the props from a perpendicular relationship with respect to the struts but maintaining the props in a generally upright position for unit advance.

10 Claims, 7 Drawing Figures

MINE ROOF SUPPORTING SYSTEM

BACKGROUND OF THE INVENTION

This invention relates to mine roof support systems and more particularly, it concerns improvements in mine roof support systems of the type including a plurality of telescopically interconnected support units arranged to provide transverse parallel lines of roof support over a work area and capable of being self-advanced during mining operations.

As exemplified in U.S. Pat. No. 2,795,935-Fitzgerald, No. 2,795,936-Blower et al and No. 4,143,991-Stafford, mine roof support systems are known to be available for continuous mining operations in which a plurality of inverted U-shaped units are capable of self-advancement with mining operations to protect the working area between the mining face and the area under a roof which has been permanently reinforced such as by timber and/or roof bolting. In contradistinction to well-known roof jacks used in long-wall mining operations, the units of the systems disclosed in these patents are arranged in tandem and each include a transverse beam or truss supported at opposite ends by a pair of extensible props so that the units lie perpendicular to the direction of advance rather than parallel to the direction of advance as in the case of long-wall jacks. In a manner common to most self-advancing roof support systems used in mining operations, these systems employ telescopic struts between successive units so that as one unit is retracted away from the mine roof, it may be pushed or pulled by extension or contraction of the struts reacting with another unit which is fixed as a result of it being forcibly retained between the mine floor and the mine roof.

To facilitate an understanding of component orientation in mine roof support systems of the type under discussion, the term "unit plane" will be used hereinafter to designate a plane containing the central axes of the transverse roof engaging beam and of the extensible props supporting opposite ends of the beam for each inverted U-shaped unit of the system. In light of basic system geometry, therefore, each unit plane will be generally vertical and perpendicular to the direction of system advance with mining operations as well as generally perpendicular to the struts extending between and interconnecting successive units of the system. Also, it will be appreciated that maximum roof support capability will be obtained when the unit plane and the axes of both unit props in that plane are truely vertical irrespective of undulations in the mine floor or roof, relative inclination of the mine floor or roof in the unit plane and the like.

Maximum roof supporting capacity has been achieved in such systems by appropriate pivotal interconnection of the props with the beams in each unit as well as of the struts with the props between successive units. To retain each unit in an essentially erect condition when the beam thereof is retracted away from the roof for longitudinal advance of the unit, however, provision must be made for stabilizing the pivotal connection of components. For example, the props and beam of each unit must be restored and retained in an essentially perpendicular relationship and also the connection of the longitudinal struts with the props of a retracted unit must be maintained near perpendicular to assure that the unit plane of a unit being advanced relative to another unit will remain essentially vertical while at the same time accommodate undulations in the mine floor. In the past, these requirements have involved design compromise between structural integrity and ruggedness required by the mining environment on the one hand and, on the other hand, a kind of simplicity important to such factors as cost and weight reduction as well as efficient and safe mining conditions which necessitate a minimum of interference by the support system with maneuverability of mining equipment and personnel.

SUMMARY OF THE INVENTION

In accordance with the present invention, an improved stabilizing arrangement and structure is provided for mine roof support system of the type including a series of support units interconnected by extensible struts and each having a transverse beam supported at opposite ends by extensible props. The connection of each prop to the beam of a unit is through a coupling sleeve and spherical bearing pad to permit at least limited pivotal movement of the prop and beam in all directions. A stabilizing bracket extends between the upper end of each prop and the beam to impose a yieldable bias on this connection so that in the absence of a roof supporting load on each unit, the props and beam will be retained in a true perpendicular orientation in relation to each other.

The struts interconnecting successive units of the system are established by a pair of telescopic, hydraulically actuated, piston/cylinder assemblies. The opposite ends of each strut thus constituted are pivotally connected to the props of successive units by a loose clevis-type coupling to permit unrestricted pivotal movement on a vertical axis and limited movement about a horizontal coupling axis. A vertical prop engaging bracket is secured at at least one end of each strut and positively restricts pivotal movement of the prop, and thus of the unit plane containing the prop, to limited angular movement with respect to the strut. In this way, each support unit is maintained in a generally vertical unit plane while at the same time permitted limited canting movement at the strut connection. Accordingly, successive support units may move up and down in relation to each other as a result of undulations in the mine floor over which each unit is advanced by telescopic actuation of the struts.

Among the objects of the present invention are, therefore: the provision of an improved self-advancing mine roof support system of the type in which a series of inverted U-shaped supporting units are sequentially advanced by telescopic actuation of struts interconnecting the respective units; the provision of an improved stabilized pivotal connection of load bearing components of such a system; the provision of such a system which is adaptable to diverse heights of mine roofs; and the provision of an improved bracket structure for maintaining a generally vertical orientation of each support unit during advancing movement thereof.

Other objects and further scope of applicability will become apparent from the detailed description to follow taken in conjunction with the accompanying drawings in which like parts are designated by like reference numerals.

DETAILED DESCRIPTION OF THE PREFERRED EMBODIMENTS

Figure 1:
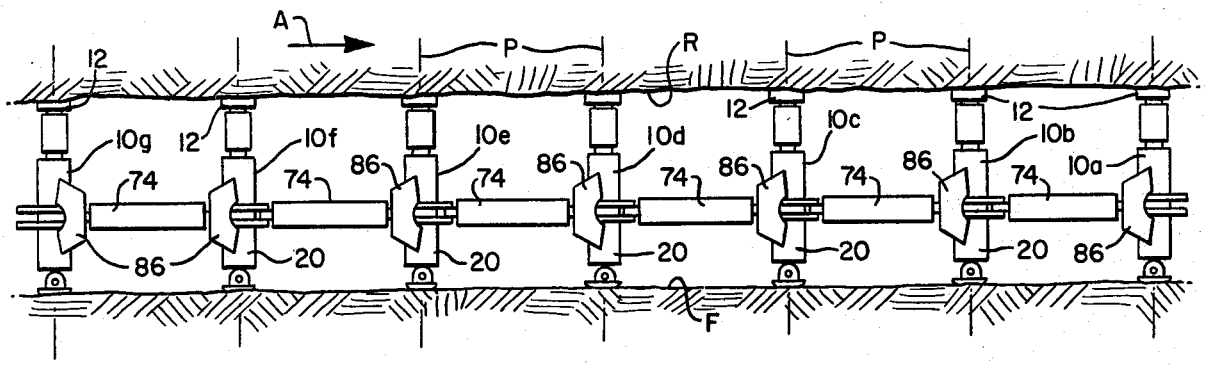
FIG. 1 is a side elevation illustrating the mine roof support system of the invention.
Figure 2:
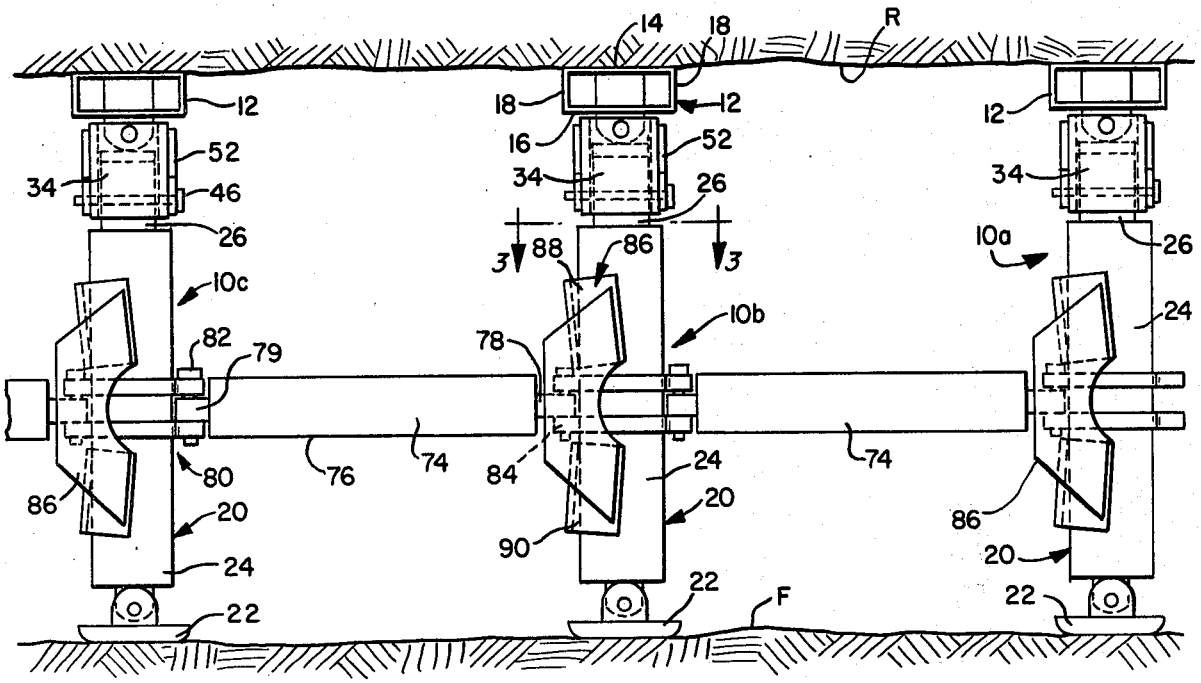
FIG. 2 is an enlarged fragmentary elevation similar to FIG. 1.
Figure 3:
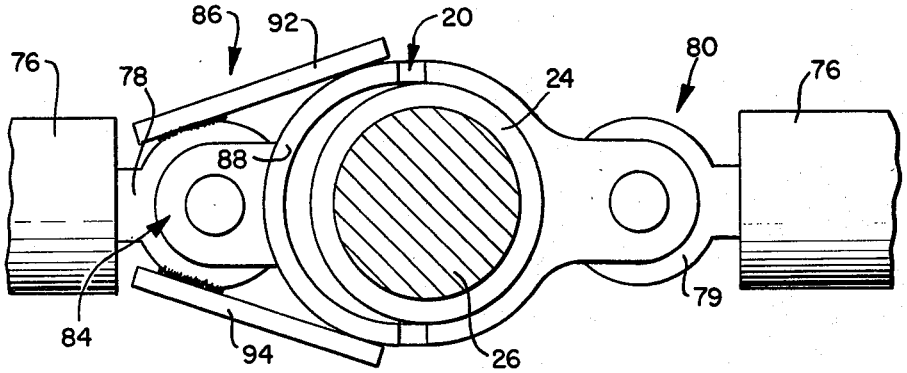
FIG. 3 is an enlarged fragmentary cross-section on line 3—3 of FIG. 2.
Figure 4:
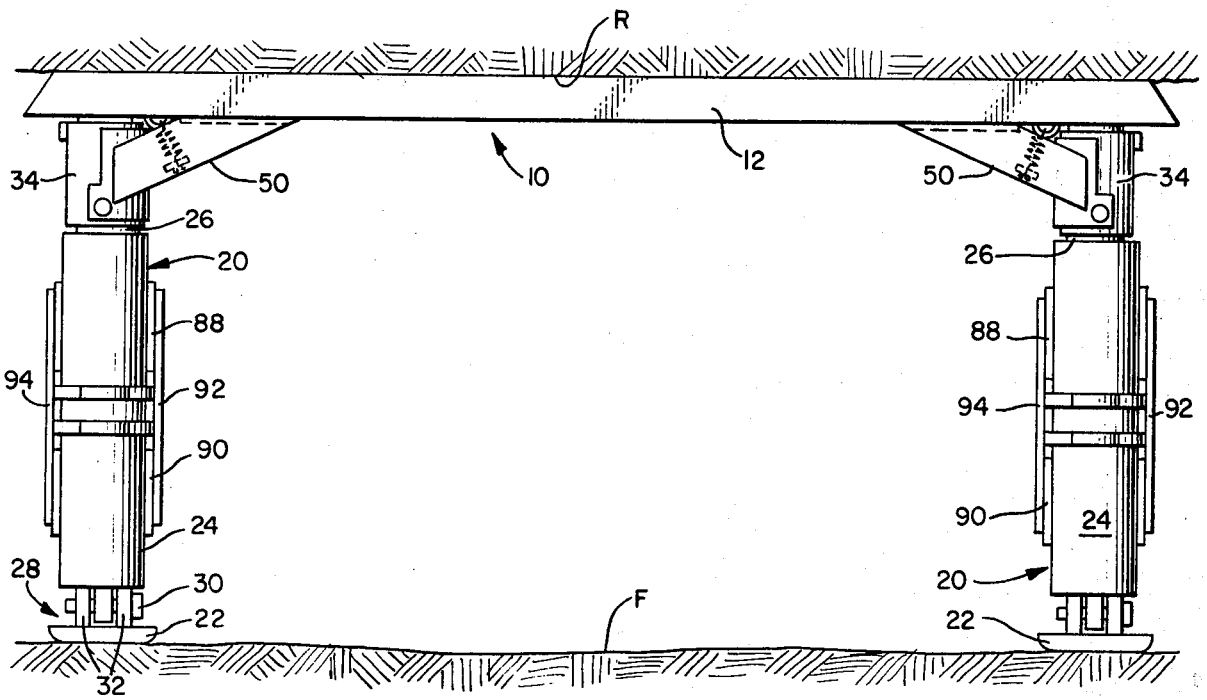
FIG. 4 is a front elevation of the system illustrated in FIGS. 1 and 2.

In FIGS. 1, 2 and 4 of the drawings, the mine roof supporting system of the present invention is shown to include a plurality of roof supporting units 10*a*–10*g* in position on a mine floor F to support a mine roof R. In FIG. 1, seven such units are illustrated though it will be understood that in practice, the specific number of units 10 may vary in number from two to seven or more without departure from the basic system concept. Each unit 10 may be considered as lying in a unit plane P which, as shown, is generally vertical and transverse to the direction of mining operation and to the direction of system advance. For purposes of orientation, it may be assumed that the direction of system advance is from left to right in FIG. 1 as depicted by the arrow A. In this respect also, however, the particular direction of system advance is not critical.

As shown most clearly in FIGS. 2 and 4, each of the units 10 include a horizontal roof supporting beam 12 which in the disclosed embodiment, is a tubular box-beam having top, bottom and side webs 14, 16 and 18, respectively, joined to provide a rectangular cross-section. Opposite ends of the beam 12 are supported by a pair of props, each designated generally by the reference numeral 20. All of the props 20 are of identical construction and as such, each includes a mine floor engaging shoe 22 and a telescopically extensible hydraulic jack defined by a cylinder 24 and a vertically moving piston rod 26. The lower end of each cylinder 24 is pivotally connected to the shoe 22 through a clevis connection 28 including a pin 30 lying on an axis parallel to the unit plane P and, as such, perpendicular to the direction of system advance. A pair of ears 32 secured to the shoe 22 and forming part of the clevis connection 28, extend from the shoe 22 up to the base of the cylinder 24 so that compressive loading between the base or lower end of the cylinder 24 and the shoe 22 will be borne by the ears 32 as distinguished from the pin 30. Also it will be seen that the configuraion of the shoe 22 enables it to be advanced in the manner of a skid over the mine floor F.

Figure 6:
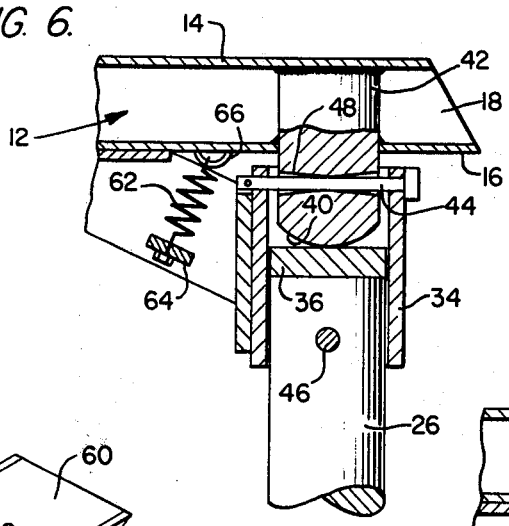
FIG. 6 is a fragmentary cross-section illustrating details of the beam and prop connection of the invention.

As shown most clearly in FIGS. 4 and 6 of the drawings, the upper end of each prop 20 is connected to one or the other of the opposite ends of the beam 12 by an assembly including a coupling sleeve 34. The lower end portion of the coupling sleeve overlaps the upper end of the piston rod 26 and contains a bearing pad or plate 36 to receive the lower spherical end 40 of a depending bearing post 42 secured rigidly to the beam 12 such as by welding to the top and bottom webs 14 and 16 thereof as shown in FIG. 6. Because the bearing pad 36 extends between the upper end of the piston rod 26 and the lower end 40 of the depending bearing post 42, it will be appreciated that the coupling sleeve 34 carries little or none of the compressive loading which, in practice, will be transmitted from the beam 12 to the piston rod 26 and the prop 20 in general. The sleeve 34 does, however, retain the connection between the beam 12 and the upper end of each prop as a result of upper and lower coupling pins 44 and 46, respectively. As shown in FIG. 6, the upper pin 44 extends through appropriate apertures in the sleeve 34 as well as through an oppositely tapered bore 48 in the post 42 so that it will not impede swiveling movement of the post 42 in the pad 36 at least within the design limits of the beam/prop connection.

Figure 5:
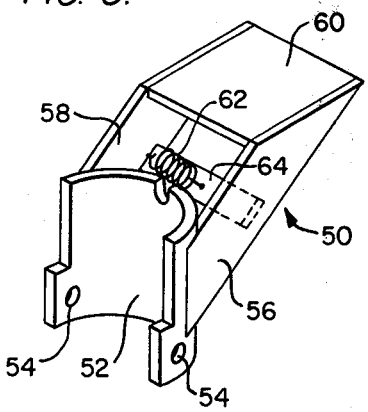
FIG. 5 is a perspective view of a stabilizing bracket structure incorporated in the invention.

To retain the beam 12 and the props 20 of each unit 10 normally in a mutually perpendicular orientation, a stabilizing bracket, generally designated by the reference numeral 50, extends between the coupling sleeve 34 of each prop 20 and the underside of the beam 12. As shown most clearly in FIG. 5, the stabilizing bracket includes a semi-cylindrical mount 52 adapted to be nested against the exterior of the coupling sleeve 34. The mount 52 includes a pair of diametrically opposite openings 54 through which the pin 46 extends. By reference to FIGS. 2 and 6, it will be seen, therefore, that the pin 46 extends through the openings 54, through aligned openings in the coupling sleeve 34 and through the upper end portion of the piston rod 26. The bracket 50 further includes a pair of upwardly extending trapezoidal gusset plates 56 and 58 welded at their lower ends to the semicylindrical mount 52 and joined at their upper ends by an abutment plate 60. As shown in the drawings, the plane of the abutment plate 60 lies perpendicular to the axis of the semicylindrical mount 52 and thus perpendicular to the axis of each prop 20. A tension spring 62 extends from a plate 64 secured such as by welding between the gusset plates 56 and 58, and a bale 66 secured to the lower web 16 of the beam 12.

The stabilizing brackets 50 as thus constructed, each provide a rigid angular member with mutually perpendicular abutment surfaces defined, respectively, by the internal nesting surface of the mount 52 and the upper planar surface of the abutment plate 60. In the system, the brackets 50 function to retain the mutually perpendicular relationship of the beam 12 and the two props 20 of each unit 10 while at the same time permitting the beam and props to assume a condition under loading in which they may be pivoted out of such a perpendicular relationship. In particular, the connection of the mount 52 by the pin 46 to the coupling sleeve 34 in combination with the alignment of each prop 20 with each coupling sleeve as a result of the overlapping condition thereof will prevent relative movement between the mount 52 and each prop 20. In mining conditions where the roof R and floor F diverge in relation to each other in a given unit plane P, upward extension of each prop 20 on opposite ends of a beam 12 will result in deflection of the beam from a perpendicular orientation to the props 20. Because the plate 60 abuts the lower web 16 of the beam under the force of the tension spring 62, such deflection of the beam and prop from a perpendicular relationship will result in elongation of the spring and pivotal separation of the plate 60 from the lower web 16 of the beam. When, however, the props 20 are retracted to lower the beam 12 away from the mine roof R, the beam 12 and props 20 will once again assume a truely perpendicular relationship as a result of the tension springs 62 forcing the abutment 60 firmly against the lower web 16 of the beam and the internal surface of the mount 52 against the sleeve 34.

Figure 7:
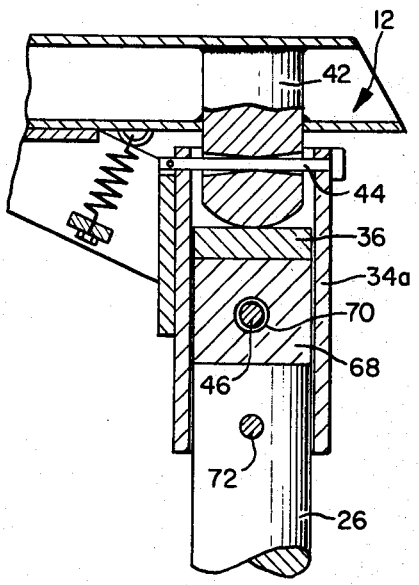
FIG. 7 is a fragmentary cross-section similar to FIG. 6 but illustrating a modified embodiment.

In FIG. 7 of the drawings, an alternative embodiment of the coupling sleeve assembly is shown. In FIG. 7, previously identified and identical parts are identified by the same reference numerals. The only modification in the structure illustrated in FIG. 7 from that shown in FIG. 6 is that the coupling sleeve 34*a* is elongated to increase the overall height of each prop 20 as may be required for mines of differing roof heights. A filler block 68 is contained within the elongated coupling sleeve 34*a* so that compressive loading from the bearing block 36 will again be transmitted through the filler block 68 to the upper end of the piston rod 26. The filler block 68 is provided with an oversized transverse bore 70 to accommodate the pin 46 with adequate clearance. An additional pin 72 is provided to couple the lower end of the sleeve 34*a* to the upper end of the piston rod 26.

With reference again to FIGS. 1 and 2 of the drawings, it will be noted that the successive units 10*a*–10*g* are interconnected longitudinally by a pair of struts 74. The struts 74, like the props 20, are in the nature of hydraulic jacks and, as such, include an outer cylinder 76 and a telescopic piston rod 78. The cylinder 76 carries an ear 79 at its base end for securement to a prop 20 through a loose clevis connection 80 having a vertically oriented pin 82. The piston rod 78 is similarly connected through a loose clevis connection 84 to a unit 10. The term "loose clevis connection" is intended to denote a clevis connection which will provide relatively unrestricted pivotal movement about the axis of the pin 82 and, in addition, permit at least limited pivotal movement about an axis transverse to the pin without stressing or otherwise imposing a bending load on the pin 82. The clevis connections 80 and 84 at opposite ends of each strut 74 are so constituted.

To retain the respective props 20 of each unit 10*a*–10*g* in a generally perpendicular relationship with the struts 74 in a manner permitting limited canting movement of the props 20 from a truely perpendicular relationship with the struts 74, a prop supporting bracket 86 is connected to each strut and positioned adjacent each prop 20. Specifically, each of the brackets 86 includes upper and lower semicylindrical prop bearing supports 88 and 90 secured by a pair of converging gusset plates 92 and 94 welded or otherwise secured to the end of either the piston rod 78 or the ear 79 at the base end of the cylinder 76 in each strut 74. The prop engaging semicylindrical members 88 and 90 diverge from the axis of the prop 20 as they progress from the strut 74 in a manner such that limited angular movement of the prop relative to the strut will be permitted but only such limited movement. The brackets 88 will function, therefore, to retain the props of each supporting unit 10 in a generally upright or vertical orientation while at the same time permit sufficient limited angular movement between the props and the struts 74 so that the props 20 of any given unit 10*a*–10*g* may be elevated with respect to an adjacent unit as may be required as a result of an undulating mine floor F.

Because of the series connection of all support units 10 by the struts 74 and because also of the intradependent connection of all struts 74 and props 20 of the system, only one prop supporting bracket 88 is required for each strut except in one instance. Specifically, the pair of struts 74 connecting the end unit 10*g* and the props of the unit 10*f* carry brackets 88 on both ends. By appropriate series relationship, any one set of struts 74 may be so equipped with two brackets 88 in order for the brackets to provide support for all props 20 in the system.

In practice, the system disclosed will be equipped with an appropriate hydraulic actuating system with controls (not shown) by which the respective props 20 as well as the struts 74 may be telescopically extended or retracted under power. In a manner described fully in the prior patents identified above, the system may be advanced under such a controlled hydraulic system by retracting the props of one or more of the units 10*a*–10*g* so that the beams 12 thereof are lowered away from the mine roof while the props of at least one or more of the units 10*a*–10*g* are extended to force the beam 12 thereof into supporting engagement with the roof R. The retracted units may then be advanced by telescopic extension of the struts 74 using the supporting units for a reaction. Thereafter the previously positioned units will be extended into roof supporting engagement whereas the units previously used for strut reaction will be advanced by telescopic retraction of the appropriate struts 74.

Thus it will be appreciated that as a result of the present invention an improved mine roof supporting system is provided by which the above mentioned objects are fulfilled. Also, it will be apparent to those skilled in the art from the preceding description that modifications and/or changes may be made in the illustrated embodiment without departure from the inventive concept manifested by the disclosed embodiment. Accordingly, it is expressly intended that the foregoing description and accompanying drawings are illustrative of a preferred embodiment only, not limiting, and that the true spirit and scope of the present invention be determined by reference to the appended claims.

I claim:

1. In a self-advancing mine roof support system having a plurality of roof support units each including a generally horizontal beam supported at opposite ends by a pair of extensible, vertically oriented props so that any one of said units may be adjusted between a roof supporting condition in which the beam thereof is advanced upwardly by the props of that unit into engagement with a mine roof and a retracted condition in which the beam thereof is lowered away from the mine roof, the roof support units being arranged in tandem so that the several horizontal beams of the system are oriented in generally parallel relationship to each other and in transverse relationship to the direction of system advance under a mine roof, a pair of extensible struts extending between and connected to the respective props of each successive two of said units so that any one of said units may be adjusted to said retracted condition and advanced by said struts acting against another of said units adjusted to said roof supporting condition, and pivotal means connecting the upper end of each prop to said beams, the improvement comprising:

a pair of stabilizing brackets to yieldably retain the props and beam of each roof support unit in perpendicular relationship when each unit is adjusted to said retracted condition and to allow the props and beams of each unit to deflect from a perpendicular relationship when adjusted to said roof supporting condition;

each of said stabilizing brackets including a rigid angular member having a pair of mutually perpendicular abutment surfaces, one such surface to engage the beam of each unit and the other of such surfaces to engage one of the props of each unit, and tension spring means to bias said abutment surfaces into engagement.

2. The apparatus recited in claim 1, comprising coupling means to establish the upper end portion of each of said props, said other abutment surface of said stabilizing bracket engaging said coupling means.

3. The apparatus recited in claim 2, wherein said coupling means comprises a tubular sleeve connected to the upper end of each of said props.

4. The apparatus recited in claim 3, wherein each of said props includes jack means defining an upwardly extensible rod having a top end, means to connect said sleeve in overlapping relationship to the top end of said rod and wherein said pivotal means comprises a post depending from each end of said beam and a bearing pad positioned within said sleeve between the top of said rod and the bottom of said depending post.

5. The apparatus recited in claim 4, including a filler block positioned within said sleeve and between said bearing pad and the top of said rod.

6. The apparatus recited in claim 2, wherein said coupling means comprises a cylindrical sleeve, the other of said abutment surfaces of said stabilizing bracket comprising a semicylindrical mount nestable against the exterior of said sleeve.

7. The apparatus recited in claim 1, wherein each of said stabilizing brackets comprises a generally horizontal abutment plate to define said one abutment surface, a semicylindrical mount to define the other of said abutment surfaces and a pair of trapezoidal gusset plates extending between and rigidly secured to said abutment plate and said mount.

8. The apparatus recited in claim 1, including means pivotally connecting opposite ends of each of said struts to said props in a manner permitting angular movement between said struts and said props, and wherein the improvement further comprises a prop supporting bracket fixed to at least one end of each of said struts, said prop supporting bracket comprising upwardly and downwardly inclined abutment surfaces to limit relative angular movement between said struts and said props.

9. The apparatus recited in claim 8, wherein said inclined abutment surfaces are defined by semicylindrical members.

10. The apparatus recited in claim 9, including a pair of converging gusset plates secured to said cylindrical members and to said struts.

* * * * *